United States Patent [19]

Schotter

[11] Patent Number: 4,960,068

[45] Date of Patent: Oct. 2, 1990

[54] FIBER GAUGING GUIDE FOR AN IN-LINE OPTICAL FIBER ADHESIVE APPLICATOR

[75] Inventor: Daniel K. Schotter, Tucson, Ariz.

[73] Assignee: Hughes Aircraft Company, Los Angeles, Calif.

[21] Appl. No.: 396,710

[22] Filed: Aug. 22, 1989

[51] Int. Cl.[5] ..... B05C 11/02

[52] U.S. Cl. ..... 118/123; 118/125; 118/419; 242/157 R; 427/355; 427/434.6

[58] Field of Search ..... 118/100, 112, 118, 123, 118/125, 405, 419; 427/355, 359, 163, 434.7, 434.6; 156/166, 169, 180, 281, 433, 578; 242/157 R

[56] References Cited

U.S. PATENT DOCUMENTS 2,695,421 11/1954 Amundson et al. ..... 118/405 X 3,681,185 8/1972 Gelb ..... 427/434.7 X 4,285,749 8/1981 Stiles ..... 156/166 X

*Primary Examiner*—Richard L. Chiesa

*Attorney, Agent, or Firm*—Robert A. Hays; Randall M. Heald; W. Denson-Low

[57] ABSTRACT

An open-ended cylindrical housing (50) with a slot (52) extending along one side contains within its bore first and second roller guides (54, 56) each having a longitudinal extending V-shaped groove (58) in an outer surface. The housing and included roller guides are located as a unit within an adhesive recovery tube (62) having a slot (66) along one side. In use, a fiber (18) with adhesive on its surface moves along the V-shaped grooves. Adjustment of the V-shaped groove aperture existing at the facing roller guide ends is accomplished by relative roller guide rotation.

12 Claims, 2 Drawing Sheets

FIBER GAUGING GUIDE FOR AN IN-LINE OPTICAL FIBER ADHESIVE APPLICATOR

BACKGROUND OF THE INVENTION

1. Field of the Invention

The present invention relates generally to applying adhesive to an optical fiber being wound onto a filament pack for a missile, and, more particularly, to a fiber adhesive gauging and guide tube device for use with in-line apparatus which applies the adhesive to the fiber.

2. Description of Related Art

Certain missiles have a length of optical fiber used as a data link. In such a case, the optical fiber is wound onto a bobbin or canister carried by the missile, one end of which is connected to control apparatus aboard the missile, while the other end is connected to further apparatus located at the launch site. During missile launch, the optical fiber unwinds from the canister to maintain the data link.

It is preferable to apply adhesive to the optical fiber while winding the filament stack on the canister in order to maintain geometric and dimensional integrity of the stack during storage. An excellent inline filament and adhesive applicator is that disclosed in co-pending application Ser. No. 07/385,026 filed on July 25, 1989, entitled "In-Line Filament Cleaner and Adhesive Applicator" by Daniel K. Schotter, assigned to the same assignee as the present application This prior art apparatus includes first and second ranks located in side-by-side relation, the first having a quantity of cleaning solvent and the second containing a liquid adhesive material. A series of pulleys are arranged to pass the optical fiber, first through the cleaning solvent, then through an air-dry station, and finally through the adhesive tank. As a final step in the processing, immediately prior to winding onto the canister, the fiber with adhesive thereon is moved through a gauging and guide tube which removes excess adhesive from the fiber surface and smooths it over the fiber surface to achieve a uniform adhesive coating. The guide tube has a single groove in the upper surface of a cylindrical rod along which the fiber moves after leaving the adhesive tank. The groove gauges the adhesive onto the fiber surface removing surplus adhesive from the fiber which is allowed to drain into a collection tank for return to the adhesive tank and subsequent use. The gauging and removal of surplus adhesive is accomplished in this prior art technique by passing the fiber along a groove on the surface of a rodlike member located within a cylindrical sleeve. No adjustment of the aperture size is provided for.

Needle-like tubes have been used to guide the optical fibers and simultaneously gauge adhesive application, however, they suffer from the disadvantage that to remove the fiber, either the fiber must be broken or the full length of fiber must pass through the needle-like tube. Such tubes are nor adjustable in cross-section and, therefore, must be replaced in the event a different size aperture is required.

In a further copending U.S. application, "A Fiber Guide", Ser. No. 07/284,978 filed on Dec. 15, 1988 and now U.S. Pat. No. 4,925,126 by D. K. Schotter there is disclosed a guide consisting of a pair of notched members received within a sleeve having a slot down one side. When the notches are aligned with the slot the fiber can be located in the notches and rotation of the members with respect to each other secures the fiber therein and provides a measure of adjustability of the member opening through which the fiber moves. A difficulty with this device is the tendency for leakage of adhesive which occurs over a wide range of adjustments.

SUMMARY OF THE INVENTION

In accordance with the present invention, there is provided an improved adhesive gauging and guide tube device including a cylindrical tubular housing with a slot extending along the full length of the wall. A hollow adhesive recovery tube has a slot extending its full length and has an inner diameter enabling a sliding fit about the tubular housing.

First and second cylindrical roller fiber guides are provided of substantially identical construction. Each roller guide includes a V-shaped groove formed in the outer surface extending completely along the full length of the guide with the groove bottom lying substantially along the guide longitudinal central axis. The two guides are mounted within the tubular housing in end-to-end relation with the V-groove of the first encountered guide extending generally downward, and the second at 180 degrees thereto or facing generally upward.

In use, the device parts are disassembled and the fiber is laid into the V-grooves of the two roller guides held in end-to-end relation. The adhesive recovery tube is fixedly mounted at a convenient point with its slot facing upward. The roller first encountered by the fiber after it has had adhesive applied to it, has its groove facing generally downwardly and the other roller faces generally upwardly. Rotation of the first roller varies the aperture occurring at the contact faces of the rollers and, in that way, varies the adhesive gauging. As the fiber moves along the roller grooves the adhesive is smoothed and reduced to a uniform thickness, primarily at the interface between the rollers, and excess adhesive moves along the recovery tube to drain into a suitable recovery tank.

Other objects and advantages of the present invention will become apparent to those skilled in the appertaining art from the following description when read in conjunction with the attached drawings and appended claims.

DESCRIPTION OF A PREFERRED EMBODIMENT

Figure 1:
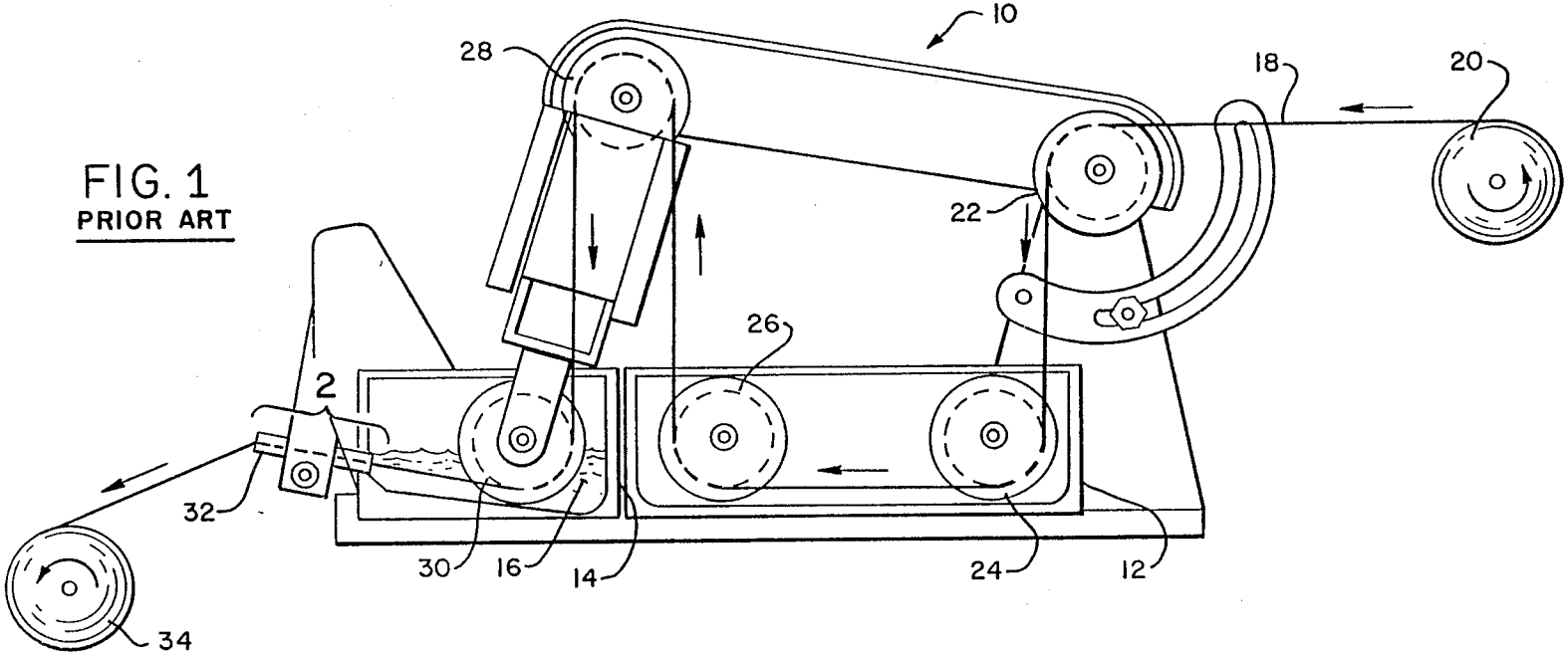
FIG. 1 PRIOR ART
FIG. 1 is a side elevational sectional view of an in-line cleaning and adhesive applicator of the prior art.

Turning now to the drawings, and particularly FIG. 1, the prior art in-line cleaning and adhesive applying apparatus of the referenced patent application is identified generally as 10. More particularly, the apparatus includes a first tank 12 containing a quantity of cleaning solvent located adjacent a second tank 14 which includes a quantity of adhesive 16. An optical fiber 18 which has been removed from a storage spool 20 is moved along a path by a number of pulleys 22, 24, 26, 28 and 30 through the cleaning tank 12, then through an air-drying station adjacent to pulley 28, and finally through the adhesive tank 14 where the optical fiber has its surface loaded with a quantity of the adhesive. On the fiber 18 leaving the adhesive tank, it passes through a tubular guide and gauging means identified generally as 32 where the excess adhesive is removed from the fiber and the adhesive is also smoothed along the fiber's surface so as to evenly coat the fiber. After the adhesive is gauged onto the fiber, the adhesive coated fiber is directly wound onto the bobbin or canister 34 forming the data link stack to be installed on the missile. Lack of adjustability of the aperture formed by a groove on a rodlike member in 32 makes the tubular guide and gauging means not completely satisfactory.

Figure 2:
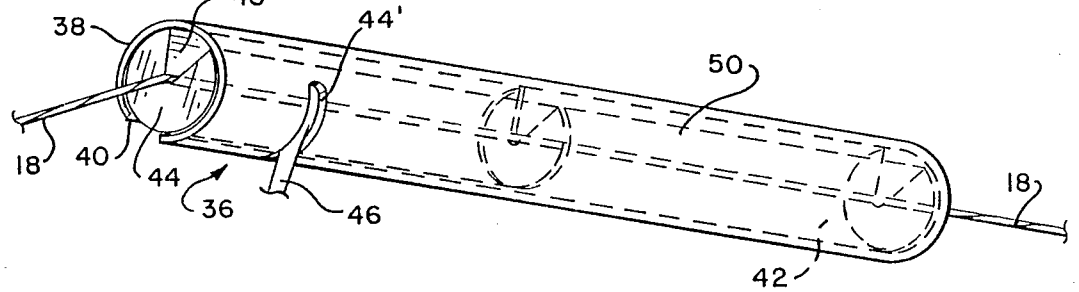
FIG. 2 PRIOR ART
FIG. 2 is a side elevational view of a further prior art gauging guide device.

FIG. 2 shows the fiber guide 36 as described in the copending patent application, "A Fiber Guide", which is seen to include a tubular sleeve 38 with a slot 40 along one side, a first member 42 fixed within the sleeve, and a second member 44 rotatably positioned within the sleeve. The second member can be rotated by lever arm 46 extending through a transverse slot 44, to vary the aperture formed by the relative orientation of member V-grooves 48 and 50. In use, substantial leakage of adhesive is encountered through the slot 40 over a substantial range of orientations.

Figure 3:
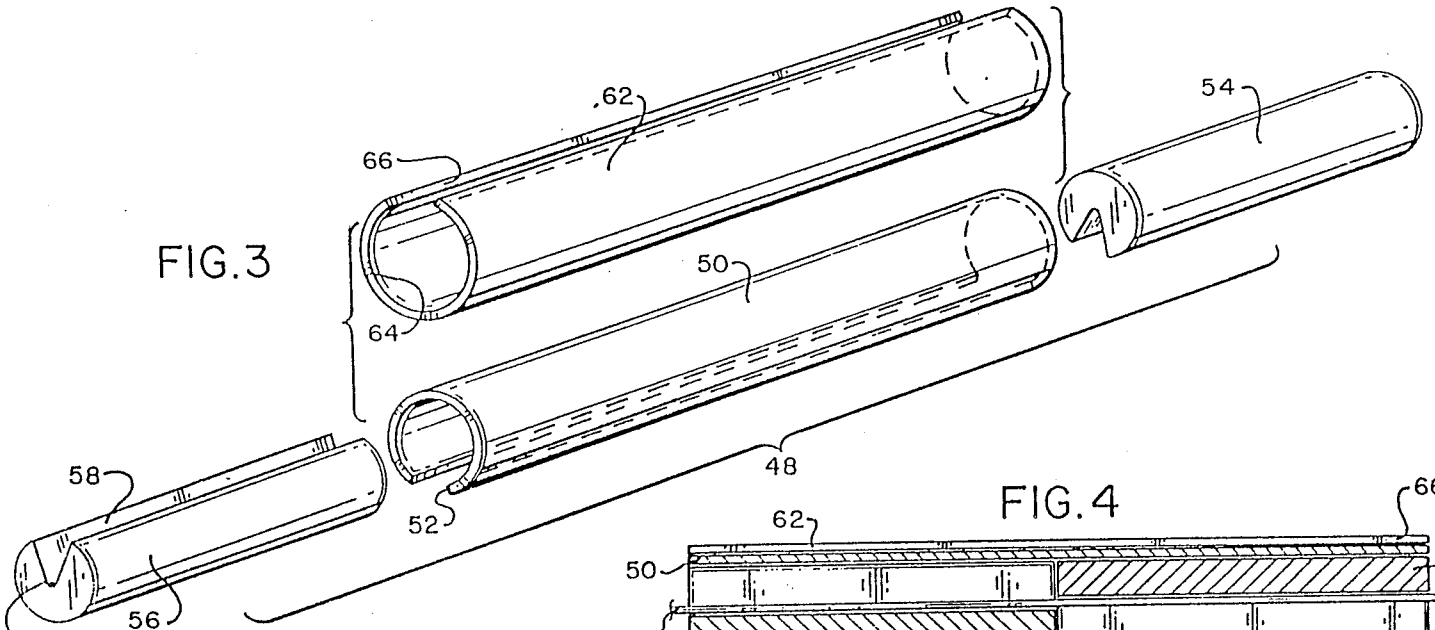
FIG. 3 is an exploded view of the fiber gauging guide device of this invention.

The adhesive gauging and fiber guide device of the present invention is depicted in FIG. 3 and identified generally as 48 and it is seen that the device has a tubular housing 50 with a slot 52 extending completely along one side, the internal bore of which is circular in cross-section with a uniform diameter. First and second cylindrical roller fiber guides 54 and 56 are of identical construction and, therefore, only the guide 54 will be described in detail.

The guide 54 constructed of a hardened steel or ceramic material is of circular cross-section and has a total length substantially equal to one-half that of the housing 50. On one side there is formed a V-shaped groove 58 extending completely along the body in a straight line. The groove bottoms at substantially the cylindrical axis for the guide, the bottom of the groove identified as 60 being slightly radiused in order to allow an optical fiber 18 to move therealong and not become wedged. Additionally, the surface of the groove is smooth and regular so as not to catch or in any way damage or stretch the optical fiber.

Figure 4:
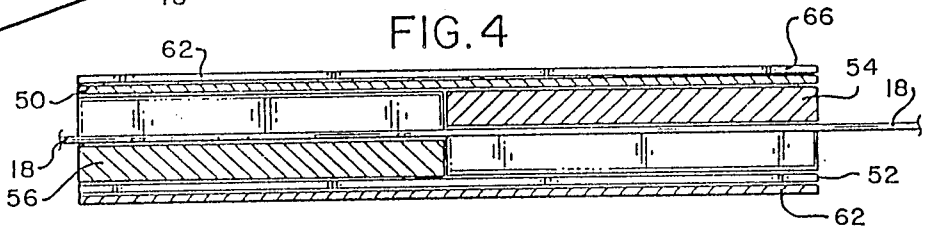
FIG. 4 is a side elevational sectional view taken along the line 4—4 of FIG. 7.
Figure 5:
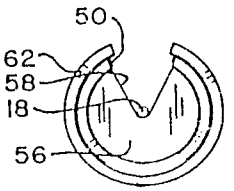
FIGS. 5, 6 and 7 are end elevational sectional views showing a guide cylinder in various angular positions of adjustment.

The housing 50 and included roller fiber guides 54, 56 are positioned within the adhesive recovery tube 62 which can be constructed identically to the housing except that its internal bore 64 must be sufficient to slidingly receive the housing as shown in FIGS. 4 and 5. The recovery tube has a slot 66 similar to the slot 52 of the housing 50. The adhesive recovery tube 62 is fixedly mounted at a convenient location along the path of fiber movement after adhesive is applied, the tube slot 66 facing upward.

Initially, the two roller guides 54 and 56 are assembled within the recovery tube and housing with the V-shaped grooves 58 of each guide and the slots 52 and 66 all being aligned and facing upward. The fiber is then located within the V-grooves of the two guides. The guide 56 which is the last one that the fiber contacts prior to being wound onto the stack 34 has its V-groove facing vertically upwardly. The other guide 54 which has been press fit into the housing 50 is then rotated with the housing so that its V-groove faces vertically downward. Now, as the fiber moves therethrough adhesive which is removed primarily by contact with the guide walls forming an aperture at the interface between the two guides, drains out through the recovery tube into a suitable receptacle (not shown) and does not leak out of the device as in the past.

Figure 6:
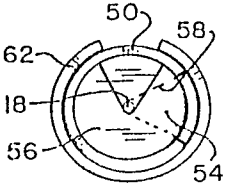
Figure 7:
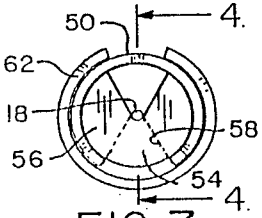

In addition to elimination of the leakage problem, the device is still adjustable by merely rotating the housing 50 and guide 54 as a unit. FIG. 5 shows the device fully open with the guide grooves aligned. FIG. 6 shows the V-shaped grooves partly closed and FIG. 7 shows the aperture closed to the minimum adjustment or fully closed.

Although the present invention has been described in connection with a preferred embodiment, it is to be understood that those skilled in the art will recognize other embodiments, changes, variations and configurations that can be utilized and still remain within the spirit of the invention.

What is claimed is:

1. Apparatus for gauging the thickness of an adhesive material adhered to an optical fiber and guiding the fiber, comprising:

a hollow cylindrical tube including a bore of uniform diameter and a single slot extending longitudinally completely along one side;

a hollow cylindrical housing with a slot along one side, said housing being so dimensioned as to enable sliding receipt within the tube bore;

first and second roller guides, each having cross-sectioned dimensions enabling sliding receipt within the housing and a V-shaped slot extending completely along one side;

said first and second roller guides being located within the tube in end-to-end relation with the V-shaped grooves of each facing generally in opposite directions for slidingly receiving the fiber and adhesive thereon within the grooves, and said housing with roller guides being located within the tube.

2. Apparatus as in claim 1, in which the bottom of each V-shaped groove is radiused sufficiently to prevent wedging of the fiber therein.

3. Apparatus as in claim 1, in which the bottom of each groove is colinear with the housing longitudinal centerline.

4. Apparatus as in claim 1, in which one of said roller guides is fixedly secured within the housing and the other roller guide is rotatably positioned within the housing.

5. Apparatus as in claim 4, in which the hollow cylindrical tube is mounted with the slot facing generally vertically upward and the housing is positioned within the tube bore with the housing slot facing downward; said roller guide fixedly secured within the housing being that guide first encountered by a fiber guided therethrough.

6. Apparatus as in claim 1, in which the roller guides are constructed of a ceramic material.

7. Apparatus as in claim 1, in which the roller guides are constructed of hardened steel.

8. A device for receiving a moving optical fiber having a quantity of adhesive adhered to its surface, for gauging the adhesive to a predetermined thickness on the fiber and for guiding the adhesive coated fiber along a given direction to be wound upon a canister, comprising:

a hollow cylindrical tube of uniform diameter bore and including a slot extending completely along one side, said tube having a fiber entrance end and a fiber exit end;

an open-ended housing with a slot extending along one wall rotatably positioned within the tube bore with the housing slot facing generally downward;

means for fixedly mounting the tube with its slot facing generally upwardly;

a first roller guide having a V-shaped groove along one side for receiving the fiber therein, said first guide being fixedly secured within the housing adjacent the tube entrance end with the guide groove facing downwardly;

a second roller guide having a V-shaped groove along one side for receiving the fiber therein, said second guide being rotatably positioned within the housing adjacent the tube exit end with the groove facing generally upwardly; and an adhesive recovery tank located adjacent the tube entrance end.

9. A device as in claim 8, in which the bottom of each V-shaped groove is radiused sufficiently to prevent wedging of the fiber therewithin, and the bottoms of the grooves are each colinear with the housing center axis.

10. A device as in claim 9, in which the roller guides are end abutted and can be rotated with respect to each other to provide a variable size opening for the fiber at the abutting surfaces of the roller guides.

11. A device as in claim 8, in which the roller guides are constructed of a ceramic.

12. A device as in claim 8, in which the roller guides are constructed of hardened steel.

* * * * *